US009377238B2

(12) United States Patent
Hall et al.

(10) Patent No.: US 9,377,238 B2
(45) Date of Patent: Jun. 28, 2016

(54) REFRIGERATOR WITH A SCISSOR-TYPE LIFT MECHANISM

(71) Applicant: Electrolux Home Products, Inc., Charlotte, NC (US)

(72) Inventors: David L. Hall, Piedmont, SC (US); Partap Chaudhary, Anderson, SC (US); Avinash Gholap, Anderson, SC (US)

( * ) Notice: Subject to any disclaimer, the term of this patent is extended or adjusted under 35 U.S.C. 154(b) by 0 days.

(21) Appl. No.: 13/827,093

(22) Filed: Mar. 14, 2013

(65) Prior Publication Data

US 2014/0265806 A1 Sep. 18, 2014

(51) Int. Cl.

| | |
|---|---|
| ***F25D 25/04*** | (2006.01) |
| ***F25D 25/02*** | (2006.01) |
| *F25D 23/02* | (2006.01) |

(52) U.S. Cl.

CPC ..... *F25D 25/025* (2013.01); *F25D 23/021* (2013.01); *F25D 25/04* (2013.01)

(58) Field of Classification Search

USPC ..... 312/402, 404, 405, 405.1, 408, 312/319.5–319.8, 310; 108/144.11, 145, 108/147

See application file for complete search history.

(56) References Cited

U.S. PATENT DOCUMENTS

| | | | | |
|---|---|---|---|---|
| 2,531,880 | A * | 11/1950 | Herring | 248/669 |
| 2,769,678 | A | 11/1956 | Wolters | |
| 2,812,226 | A | 11/1957 | Wolters | |
| 3,982,801 | A | 9/1976 | Heidorn et al. | |
| 5,115,822 | A | 5/1992 | Nichols | |
| 5,971,513 | A | 10/1999 | Cassalia | |
| 6,247,771 | B1 | 6/2001 | Miller | |
| 6,510,858 | B1 | 1/2003 | Halstead et al. | |
| 6,516,478 | B2 * | 2/2003 | Cook et al. | 5/611 |
| 6,523,919 | B1 | 2/2003 | Israelsen et al. | |
| 6,622,740 | B1 | 9/2003 | Durazzani | |
| 7,165,415 | B2 | 1/2007 | Nam et al. | |
| 7,232,196 | B2 | 6/2007 | Kwon et al. | |
| 7,396,093 | B2 * | 7/2008 | Jeong et al. | 312/402 |
| 7,581,796 | B2 * | 9/2009 | Jeong et al. | 312/402 |
| 7,628,461 | B2 * | 12/2009 | Carden et al. | 312/402 |
| 7,810,891 | B2 * | 10/2010 | Lee et al. | 312/402 |
| 8,015,638 | B2 * | 9/2011 | Shimada et al. | 5/611 |
| 8,172,347 | B2 * | 5/2012 | Lim et al. | 312/408 |
| 8,474,928 | B2 * | 7/2013 | Ertz et al. | 312/402 |
| 8,544,391 | B2 * | 10/2013 | Knox et al. | 108/145 |
| 2004/0040480 | A1 * | 3/2004 | Hwang | 108/145 |
| 2004/0056573 | A1 * | 3/2004 | Chae | 312/404 |
| 2004/0094077 | A1 * | 5/2004 | Stone | 108/147 |
| 2004/0163687 | A1 * | 8/2004 | Son et al. | 134/58 D |
| 2004/0244825 | A1 | 12/2004 | Ashton | |
| 2005/0073225 | A1 | 4/2005 | Kwon et al. | |
| 2006/0022564 | A1 * | 2/2006 | Oh et al. | 312/402 |
| 2006/0037518 | A1 * | 2/2006 | Lopez Alba | 108/145 |
| 2006/0042305 | A1 | 3/2006 | Oh | |

(Continued)

*Primary Examiner* — Daniel Rohrhoff

(74) *Attorney, Agent, or Firm* — Pearne & Gordon LLP

(57) ABSTRACT

A refrigerator is provided including a refrigerator compartment with slides configured to be positioned within the refrigerator compartment, a bin door configured to cover a front of the refrigerator compartment and attached to the slides, a storage bin configured to be supported by the slides, and a lift mechanism including a first support structure configured to support the storage bin, a second support structure attached to the bin door, at least one support assembly attaching the first support structure and the second support structure, and a drive unit operatively connected to the support assembly to selectively change the distance between the first and second support structure.

23 Claims, 6 Drawing Sheets

(56) References Cited

U.S. PATENT DOCUMENTS

| | | | | |
|---|---|---|---|---|
| 2006/0043848 | A1 | 3/2006 | Jeong | |
| 2006/0087207 | A1 | 4/2006 | Oh et al. | |
| 2006/0087208 | A1 | 4/2006 | Oh et al. | |
| 2006/0096304 | A1 * | 5/2006 | Kim et al. | 62/132 |
| 2006/0097611 | A1 | 5/2006 | Kim et al. | |
| 2006/0103273 | A1 | 5/2006 | Lee et al. | |
| 2006/0104756 | A1 | 5/2006 | Kim et al. | |
| 2006/0196198 | A1 | 9/2006 | Kim et al. | |
| 2006/0207283 | A1 * | 9/2006 | Kim et al. | 62/407 |
| 2006/0226749 | A1 | 10/2006 | Kim | |
| 2006/0242988 | A1 * | 11/2006 | Kim et al. | 62/441 |
| 2007/0034125 | A1 * | 2/2007 | Lo | 108/145 |

* cited by examiner

REFRIGERATOR WITH A SCISSOR-TYPE LIFT MECHANISM

BACKGROUND OF THE INVENTION

1. Field of the Invention

The present invention relates generally to refrigerators, and more particularly, to refrigerators with a lift mechanism including a scissor support assembly.

2. Description of Related Art

Traditional refrigerators have been designed with two refrigerator compartments positioned in various ways. For example, it is known to provide one refrigerator compartment above another refrigerator compartment. A lower storage compartment can include a storage bin.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a refrigerator is provided including a refrigerator compartment, a storage bin positioned within the refrigerator compartment, and a lift mechanism. The lift mechanism includes a first support structure configured to support the storage bin, a second support structure configured to support the first support structure, and at least one scissor support assembly coupled between the first support structure and the second support structure; wherein the first support structure is configured to selectively raise and lower with respect to the second support structure.

In accordance with another aspect, a refrigerator is provided including a refrigerator compartment, a storage bin positioned within the refrigerator compartment, and a lift mechanism. The lift mechanism includes a first support structure configured to support the storage bin, a second support structure configured to support the first support structure, at least one scissor support assembly including a first arm and a second arm, wherein the first arm is configured to be pivotally attached to the second support structure and slidably attached to the first support structure, further wherein the second arm is configured to be slidably attached to the second support structure and pivotally attached to the first support structure, and a first drive unit operatively connected to the at least one scissor support assembly to selectively raise and lower the first support structure with respect to the second support structure.

In accordance with another aspect, a refrigerator is provided including a refrigerator compartment, a door configured to cover a front of the refrigerator compartment, a sliding mechanism configured to removably attach the door to the refrigerator compartment, a storage bin positioned within the refrigerator compartment, and a lift mechanism. The lift mechanism includes a first support structure configured to support the storage bin, a second support structure configured to support the first support structure, wherein the second support structure is configured to be attached to the sliding mechanism, at least one scissor support assembly configured to movably attach the first support structure to the second support structure, wherein the at least one scissor support assembly is configured to be slidably and pivotally attached to each of the first support structure and the second support structure, and a first drive unit including a shaft oriented along a horizontal plane and in operative association with the at least one scissor support assembly, wherein rotation of the shaft is configured to raise and lower the first support structure with respect to the second support structure.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF THE INVENTION

Figure 1:
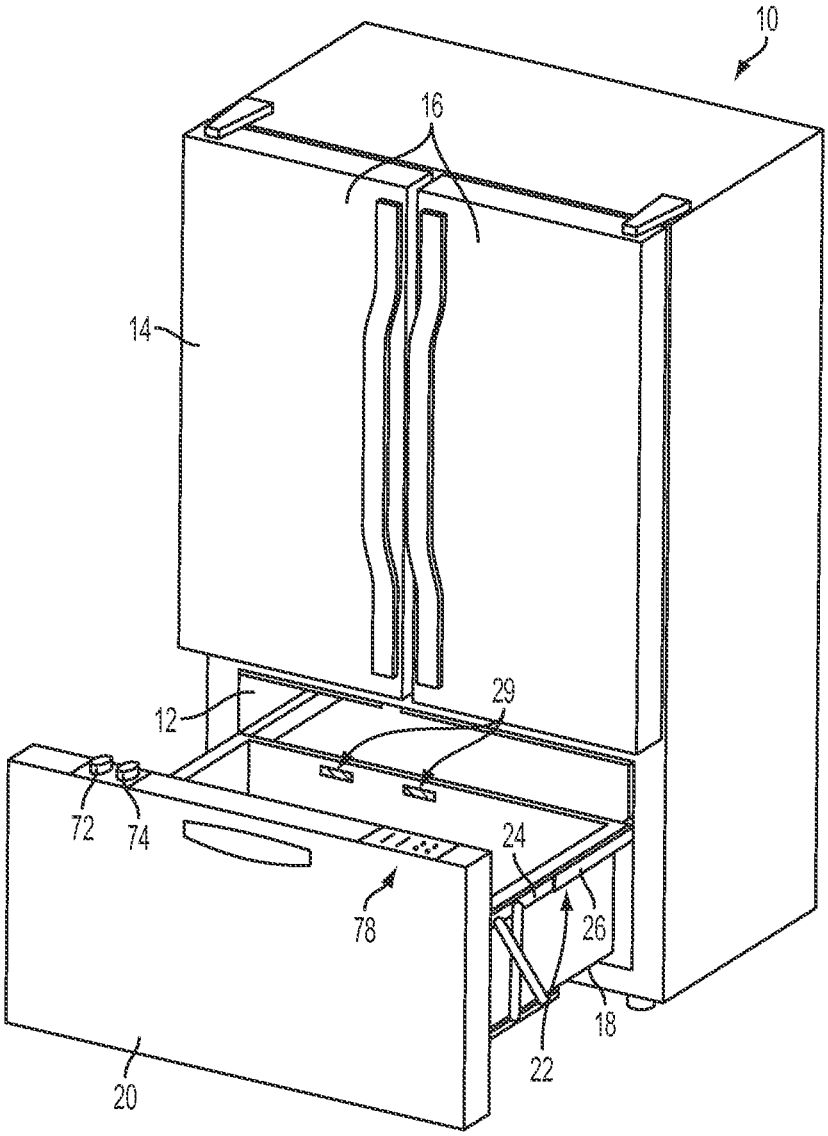
FIG. 1 is a perspective view of a bottom-mount refrigerator freezer including a lower compartment.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the shown example of FIG. 1, a refrigerator 10 is shown with two refrigerator compartments. The refrigerator 10 may include an upper compartment 14 and a lower compartment 12. The upper compartment 14 can include one or more upper doors 16 that provide access to an interior portion of the upper compartment 14. While not shown in the example, the refrigerator 10 can also include a cooling system with a compressor, heat-exchange pipes, an expansion valve, refrigerant, etc. in order to cool the refrigerator compartments.

While FIG. 1 illustrates a two compartment refrigerator, the refrigerator 10 can also include a single compartment or more than two compartments. Moreover, if provided with two or more compartments, one or more may by located above the other and/or laterally with respect to one another. Still further, one compartment may be located partially or entirely within another compartment. As another example, a two compartment refrigerator can be configured such that either one or both compartments may be maintained at a temperature above or below freezing providing for two freezers, two refrigerators, or one freezer and one refrigerator. In the shown examples, the lower compartment 12 may be kept at a temperature below freezing, such that the lower compartment 12 is functionally a freezer compartment, while the upper compartment can be kept at a temperature above freezing.

The refrigerator 10 can include a bin door 20 configured to cover a front of the lower compartment 12. The bin door 20 can include a handle, or the like, to allow a user to open and close the bin door 20. The bin door 20 can be attached to and supported by a sliding mechanism. The sliding mechanism can include at least one slide, though in the shown example, there are two slides 22. The slides 22 are positioned within the refrigerator compartment and can extendably slide the bin door 20 between an open position and closed position. The storage bin 18 can include a first slide and a second slide, such that each slide can be provided on each side of the bin door 20, however more than two slides may also be included. The slides 22 may be drawer slides that include an inner rail 24 and an outer bracket 26. The inner rail 24 may be slidingly received within the outer bracket 26. The slides 22 may be attached to the bin door 20 and lower compartment 12 at opposing ends, such that the outer bracket 26 can be attached within the lower compartment 12 while the inner rail 24 can be attached to the bin door 20. It is to be understood, however, that various configurations of the slides 22 are envisioned, and the present example is not limited to the inner rail 24 and outer bracket 26.

Referring still to FIG. 1, the lower compartment 12 may further include a storage bin 18. In one example, the storage bin 18 can be at least partially supported by the slides 22. In the alternative, the storage bin 18 can be supported by a separate structure, as will be described below. The slides 22 are configured to slide both the bin door 20 and the storage bin 18 back and forth into and out of the lower compartment 12. For example, the storage bin 18 may be positioned between the slides 22, including a first slide and a second slide, positioned within the lower compartment 12. When the bin door 20 is withdrawn into an open position as shown in FIG. 1, the storage bin 18 can be configured to move out of the lower compartment 12 along with the bin door 20. Accordingly, when the bin door 20 is moved into the closed position, the slides 22 can slide the bin door closed such that the storage bin 18 is configured to move into the lower compartment 12. With the slides 22 attached to the bin door at one end, the storage bin 18 can rest on the slides 22 and be readily removed.

The storage bin 18 may have various configurations to fit within the lower compartment 12. In one example, the storage bin 18 can have a generally rectangular box shape, open on the top to provide access to the storage area defined by the bin. The storage bin 18 may be formed of metal, plastic, or any other suitable material. The storage bin 18 may also include one or more lights 29 configured to illuminate the contents of the storage bin 18. The lights 29 can be mounted on the front side of the storage bin 18 to illuminate the storage bin 18 and its contents without being directly visible to the user. Alternately, the lights 29 can be positioned on a side and/or rear of the storage bin 18. In further examples, the lights 29 can be positioned on the bin door 20 to illuminate the storage bin 18.

Figure 2:
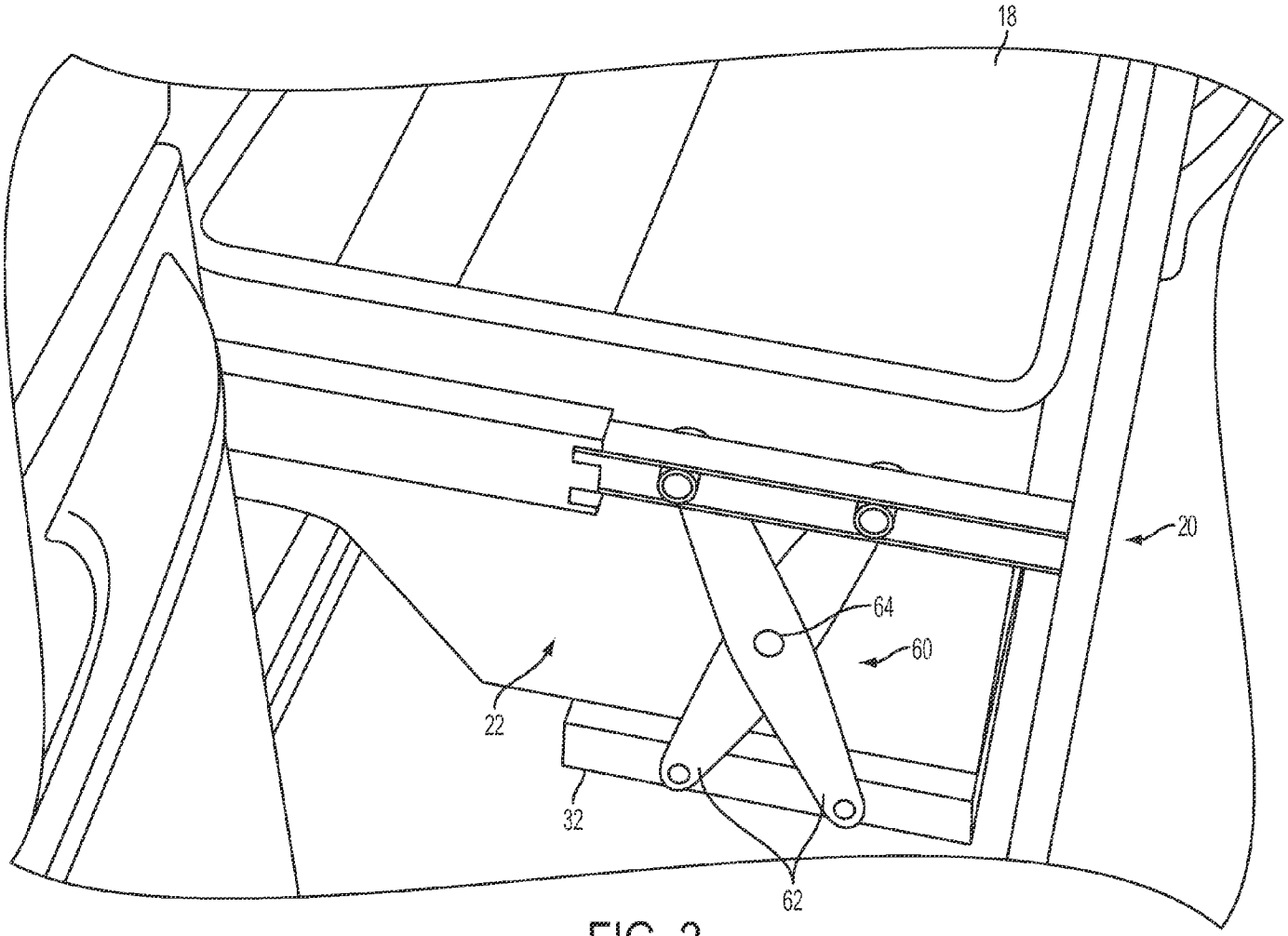
FIG. 2 is a perspective view of a storage bin in a lowered position attached to a bin door.
Figure 3:
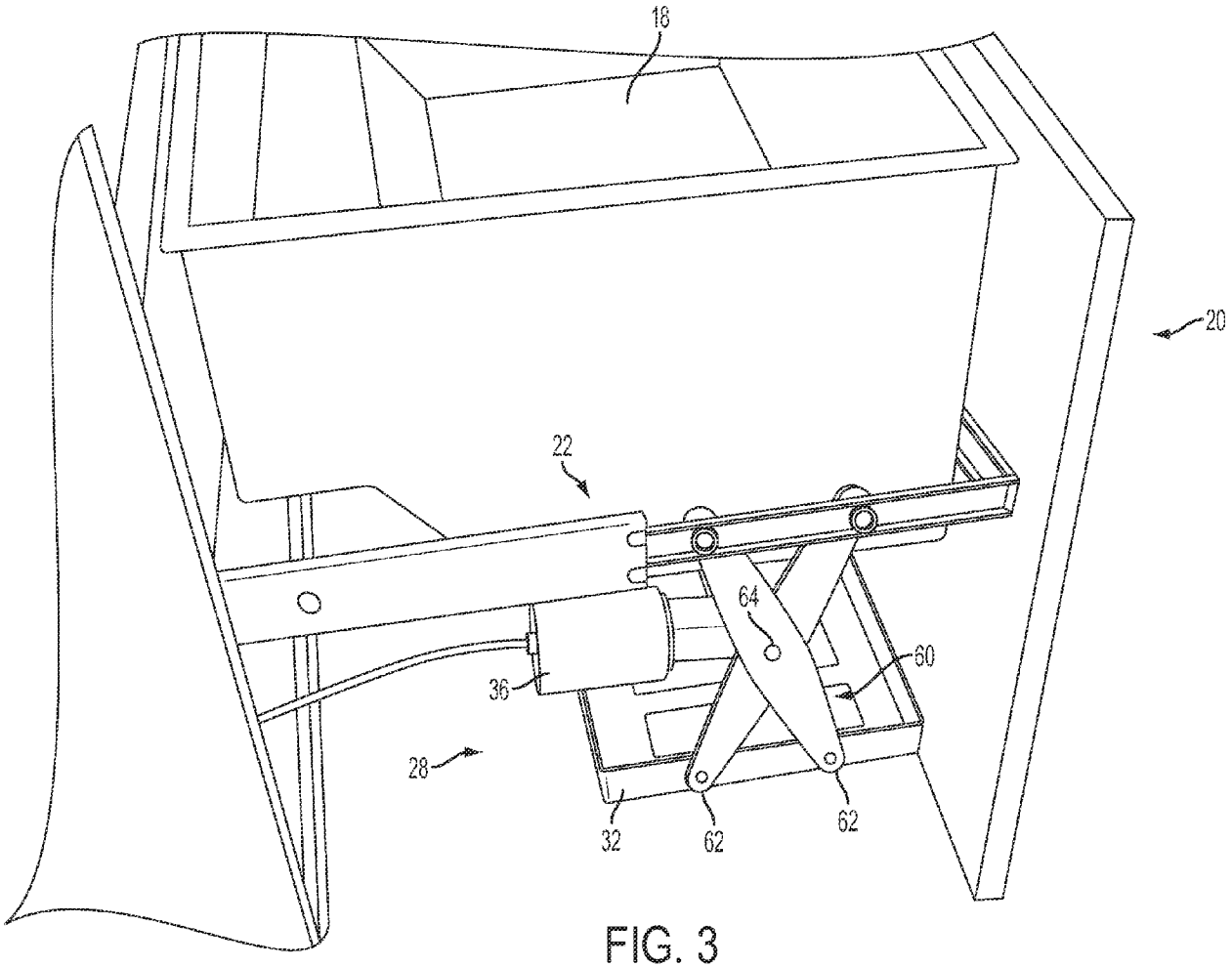
FIG. 3 is a perspective view of the storage bin in a raised position attached to the bin door.

Referring now to FIGS. 2 and 3, there is shown the storage bin 18 in a lowered position in FIG. 2, and in a raised position in FIG. 3. In the shown examples, the bin door 20 is withdrawn from the lower compartment 12. When the bin door 20 is in the fully withdrawn position, the storage bin 18 can be exposed to the user, such that the user can access the contents of the storage bin 18. As will be described in more detail below, the storage bin 18 can be moved between the lowered position and the raised position.

A lift mechanism 28 is provided for lifting the storage bin 18 from the lowered position to the raised position, and for lowering the storage bin 18 from the raised position back to the lowered position. Raising the storage bin 18 may provide easier access to the interior of the storage bin 18 for a user. While the distance of travel between the upper and lower positions may vary for different refrigerator designs, it may, for example, be from about 5 to 15 inches, or from about 8 to 10 inches. The lift mechanism 28 may be configured to rapidly move the storage bin 18 between the upper and lower positions. For example, the lift mechanism 28 may move the storage bin 18 from the lower to the upper position in less than 10 seconds, or less than 5 seconds. As will be described in more detail below, lifting or lowering of the storage bin 18 by the lift mechanism 28 may occur automatically upon withdrawing or replacing the storage bin 18 from the lower compartment 12, or it may occur only when a signal is provided by the user to raise or lower the storage bin 18. For example, as will be described below, an up/down switch may be provided such that the user can raise or lower the storage bin 18 by pressing the up/down switch.

Figure 4:
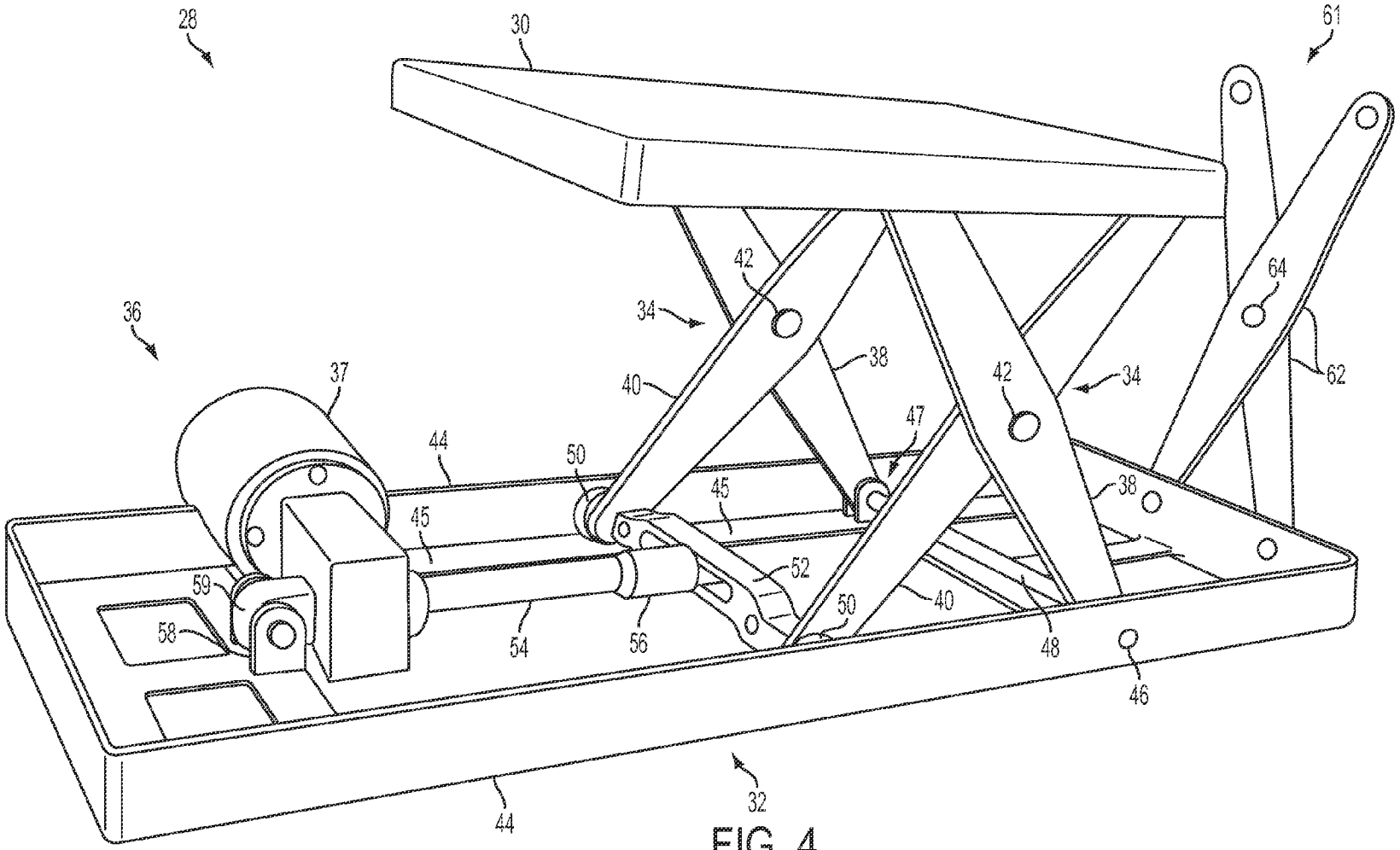
FIG. 4 is a side perspective view of a lift mechanism in the raised position in which the storage bin has been removed.
Figure 5:
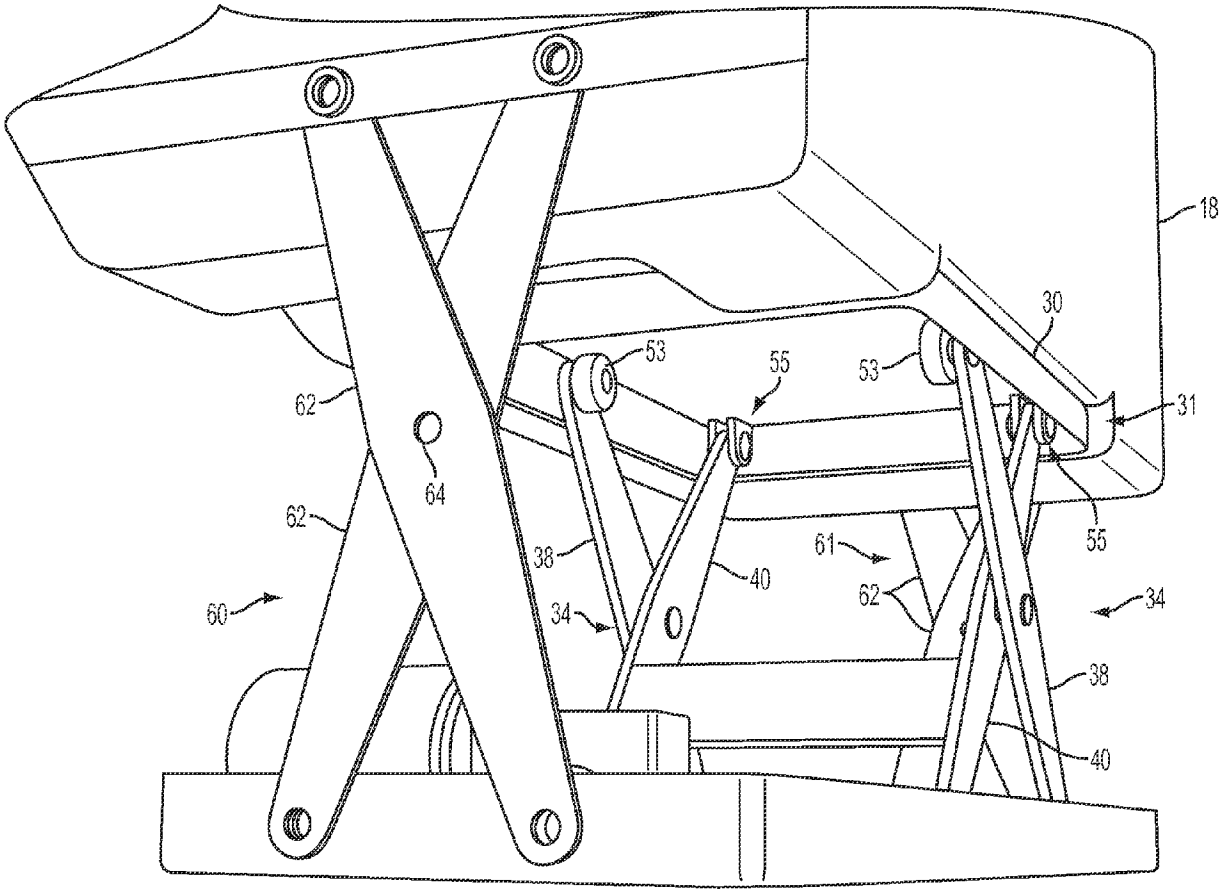
FIG. 5 is another perspective view of the lift mechanism with the storage bin in the raised position.

Referring to FIG. 4, the example lift mechanism 28 is illustrated in greater detail without the storage bin 18 in place. The lift mechanism 28 can include a support structure system, including a first support structure 30 and a second support structure 32. The first support structure 30 is configured to support the storage bin 18 and can be placed underneath and in contact with the storage bin 18, as shown in FIG. 5. Referring briefly to FIG. 5, the storage bin 18 can include a recessed portion 31 positioned at the bottom of the storage bin 18. The recessed portion can be shaped to substantially match the shape of the first support structure 30. Consequently, the first support structure 30 can be removably inserted into the recessed portion 31. The matching shape of the first support structure 30 and recessed portion 31 of the storage bin 18 can reduce movement between the storage bin 18 and the first support structure 30. In further examples, an attachment means (not shown) can be provided to attach the first support structure 30 to the storage bin 18 within the recessed portion 31. For instance, the attachment means could include a screw assembly, a snap fit means, an adhesive, or the like.

Referring now to FIGS. 4 and 5, the first support structure 30 can be a substantially rectangularly shaped structure with a flat surface covering the structure. It is to be understood, however, that the first support structure 30 can include a variety of shapes and is not limited to a rectangular shape. For instance, the first support structure 30 can be shaped as an oval, circle, square, or the like. In fact, the first support structure 30 can take a number of shapes that are configured to match the bottom of the storage bin 18 and support the storage bin 18. Similarly, the surface covering the first support structure 30 may not be flat and can be formed integrally as part of the first support structure 30, or can be attached as a separate piece, such as by welding a piece to the structure. While the first support structure 30 in the present example is metal, a number of materials are envisioned, such as plastic, stainless steel, or a plastic/metal combination.

The first support structure 30 can be raised and lowered with respect to the second support structure 32. As such, the first support structure 30 can move the storage bin 18 between the lowered position, in which the first support structure 30 is substantially planar with the second support structure 32, and the raised position, in which the first support structure 30 is positioned above the second support structure 32. Additionally, the first support structure 30 can be nested within the second support structure 32. Accordingly, when the first support structure 30 is in the raised position, the storage bin 18 will also be raised. Similarly, when the first support structure 30 is in the lowered position, the storage bin 18 will correspondingly be lowered. It is to be understood, that the first support structure 30 can move between varying positions in between the raised position and the lowered position. For instance, the first support structure 30 can stop at one or more intermediate positions somewhere between the raised and lowered positions.

The second support structure 32 can support both the first support structure 30 and the storage bin 18. The second support structure 32 can be attached to the slides 22, as shown in FIGS. 2 and 3. Moreover, a front face of the second support structure 32 could be attached to a rear surface of the bin door 20, such as by a screw and bolt assembly, a snap fit engagement, welding, an adhesive, etc. Referring to FIG. 5, a pair of cross brackets 60, 61 can support the second support structure 32 by attaching it to the slides 22. The pair of cross brackets 60, 61 shown in FIG. 5 includes bracket arms 62 that are connected at a center point 64, for example, in which the upper ends of the bracket arms 62 are attached to the slides 22 and the lower ends of the bracket arms 62 are attached to the second support structure 32. The bracket arms 62 can have a variety of configurations, and function to hold the second support structure 32 in place with respect to the slides 22 below the storage bin 18. The bracket arms 62 do not need to move relative to one another, and can be fixed in place. Accordingly, the second support structure 32 could be simultaneously attached to the slides 22 and directly to the rear of the bin door 20. As such, both the slides 22 and the second support structure 32 can be attached to the bin door 20, such that the slides 22 and second support structure 32 remain at a fixed distance from each other.

Referring to FIG. 4, the second support structure 32 may be bounded on four sides by guide tracks 44. The guide tracks 44 may form a substantially rectangular structure, though other shaped structures are envisioned. The guide tracks 44 may form outer walls of the second support structure 32. In one example, the guide tracks 44 may be formed from a single, bent piece. However, the guide tracks 44 may be formed from multiple pieces and can be attached, such as by welding or any other suitable attachment method.

The guide tracks 44 may further include rolling tracks 45. The rolling tracks 45 can project perpendicularly from the guide tracks 44 such that the guide tracks 44 extend substantially vertically while the rolling tracks 45 extend substantially horizontally. The rolling tracks 45 may be formed integrally as part of the guide tracks 44, such as by a single piece having a bent L-shaped configuration. In the alternative, the rolling tracks 45 may be attached to the guide tracks 44, such as by welding, or any other suitable attachment method. While the guide tracks 44 form the outer walls of the second support structure 32, the rolling tracks 45 may be positioned on some or all of the sides of the second support structure 32. For instance, in one example, the rolling tracks 45 may be placed only on opposing sides of the second support structure 32.

The lift mechanism 28 can further include at least one scissor support assembly 34 configured to attach the first support structure 30 to the second support structure 32. In the shown example, the lift mechanism 28 includes two substantially identical scissor support assemblies 34. However, the lift mechanism 28 could include only one scissor support assembly, or more than two scissor support assemblies. Similarly, it is to be understood that a variety of structures can be used for attaching the first support structure 30 to the second support structure 32, and is not limited to the present example.

The scissor support assembly 34 may include a first arm 38 and a second arm 40. The first arm 38 and second arm 40 are configured to extend between the first support structure 30 and the second support structure 32. The first arm 38 can be pivotally attached to the second support structure 32 at a second end. The first arm 38 can be attached to the second support structure 32 in a variety of ways. For instance, as shown in FIG. 4, the first arm 38 can be attached adjacent to the guide tracks 44 by an attachment structure 47. In the shown example, the attachment structure 47 includes two protrusions or brackets extending from the rolling tracks 45 of the second support structure 32. The two protrusions can be spaced apart by a gap, such that the second end of the first arm 38 can extend into the gap. Both the first arm 38 and the attachment structure 47 can include a hole extending therethrough, such that a screw 46 can extend through the hole. A pivot axle 48 can extend between the first arms 38. The pivot axle 48 can include a threaded hole for receiving the screw 46. Accordingly, the screws can screw into the attachment structure 47, through the first arm 38, and screw into the pivot axle 48.

It is to be understood, however, that the first arm 38 can be attached to the guide tracks 44 in a number of ways. For instance, in other examples, the first arm 38 can be attached by a screw without the pivot axle 48, or any other suitable attachment device that would allow pivoting. Further, the attachment structure 47 can be reversed, such that the first arm 38 can include two protrusions with a gap formed therebetween while the second support structure 32 can include a single protrusion configured to fit within the gap. Accordingly, the protrusions can include the hole extending therethrough, such that the screw, bolt, or the like can pivotally secure the first arm 38 to the second support structure 32. Similarly, instead of two protrusions, only one protrusion may be provided for attachment. Other possible attachment structures include a pivotable snap fit means, or a hole formed in the second support structure 32 allowing the first arm 38 to be pivotally attached to the second support structure 32. Similarly, the protrusions can be formed integrally with the second support structure 32, or can be attached as separate pieces.

Referring now to FIG. 5, the first arm 38 can be slidably attached with respect to the first support structure 30. The first arm 38 can slide with respect to the first support structure 30 in a number of ways. For instance, in the shown example, the first arm 38 can include a wheel or roller 50 attached to a first end of the first arm 38. The roller 50 can cooperate with a track formed on an interior portion of the first support structure 30. The roller 50 can allow the first end of the first arm 38 to slide with respect to the first support structure 30. It is to be understood, however, that other structures are envisioned to permit slidable movement between the first arm 38 and the first support structure 30, and that the first arm 38 is not limited to being used with the roller 50. For instance, the first arm 38 can cooperate with a slot, gap, recess, or the like (not shown) formed in the first support structure 30. Accordingly, the first arm 38 can be inserted into the slot, gap, recess, or the like to allow the first arm 38 to slide with respect to the first support structure 30. Similarly, the first arm 38 can include a projection, protrusion, or any other type of structure that extends from the first arm 38. The projection, protrusion, or the like can be inserted into the slot, gap, recess, or the like in the first support structure 30 such that the first arm 38 can directly or indirectly cooperate with the first support structure 30.

Referring still to FIG. 5, the second arm 40 is configured to extend between the first support structure 30 and the second support structure 32. The second arm 40 can be pivotally attached to the first support structure 30 at one end. In the shown example, a first end of the second arm 40 can be pivotally attached to the first support structure 30 by an attachment structure 55. In the shown example, the attachment structure 55 includes two protrusions extending from the first support structure 30. The two protrusions can be spaced apart by a gap, such that the second arm 40 can extend into the gap. Both the second arm 40 and the protrusions can include a hole extending therethrough, such that a screw, bolt, or the like can extend through the hole. Accordingly, the screw, bolt, or the like can pivotally secure the second arm 40 to the first support structure 30. It is to be understood, however, that various attachment structures are envisioned, and that the attachment of the second arm 40 to the first support structure 30 is not limited to the shown example. For instance, the attachment structure 55 can be reversed, such that the second arm 40 can include two protrusions with a gap formed therebetween while the first support structure 30 can include a single protrusion configured to fit within the gap. Accordingly, the protrusions can include the hole extending therethrough, such that the screw, bolt, or the like can pivotally secure the second arm 40 to the first support structure 30. Similarly, instead of two protrusions, only one protrusion may be provided for attachment. The protrusions can be formed integrally with the first support structure 30, or can be attached as separate pieces. Other possible attachment structures include a pivotable snap fit means, or a hole formed in the first support structure 30 allowing the second arm 40 to be pivotally attached to the first support structure 30.

Referring back to FIG. 4, a second end of the second arm 40 can be slidably movable with respect to the second support structure 32. To provide slidable motion, the second arm 40 can include a wheel or roller 50 rotatably attached at the second end of the second arm 40, which is adjacent to the second support structure 32. The roller 50 can be attached to the second arm 40 in a number of ways. For instance, the second arm 40 can include a projection or the like configured to engage the roller 50. In such an example, the projection can be inserted into a corresponding hole in the roller 50, allowing the roller 50 to rotate with respect to the projection and second arm 40. Alternatively, the roller 50 can include a projection that engages a hole in the second arm 40, such that the roller 50 rotates with respect to the second arm 40. The roller 50 is configured to allow an end of the second arm 40 to slidably move with respect to the second support structure 32. For instance, in the shown example, the roller 50 is configured to engage a path defined by the second support structure 32. More specifically, the roller 50 can rest on the rolling tracks 45. By resting on the rolling tracks 45, the roller 50 can be positioned adjacent to the guide tracks 44. As such, the rolling tracks 45 form the path along which the roller 50 can roll along.

The first arm 38 can be pivotally attached to the second arm 40 at an intermediate portion. For instance, in the shown example, the first arm 38 and second arm 40 can be pivotally attached at an arm pivot 42. The arm pivot 42 can include a pin that runs through a hole provided in each of the first arm 38 and second arm 40. It is to be understood, however, that a pin, screw, bolt, or the like can be used as the arm pivot 42 to pivotally attach the first arm 38 and second arm 40. The location of the arm pivot 42 is not limited to the location shown in the example, as the arm pivot 42 can be positioned at an intermediate location between the first support structure 30 and second support structure 32. In the alternative, the arm pivot 42 can be positioned closer to the first support structure 30 or closer to the second support structure 32.

Referring to FIG. 4, a carriage 52 can be provided to extend between the second arms 40 of the scissor support assemblies 34. The carriage 52 can be an elongated structure attached at each end to the lower ends of the second arms 40. The carriage can be attached to the second arms 40 in a number of ways, such as by a snap fit engagement, or by an attachment structure, such as a bolt, screw, or the like. The carriage 52 can include one or more apertures extending partially or completely through the carriage 52. As will be described in more detail below, the carriage 52 can assist in raising and lowering the first support structure 30, and thus the storage bin 18, with respect to the second support structure 32.

The lift mechanism 28 can further include a first drive unit 36 configured to move the first support structure 30 between the raised position and the lowered position. The first drive unit 36 can be operatively connected to the scissor support assembly 34 to selectively change the distance between the first support structure 30 and the second support structure 32. The first drive unit 36 can be attached to the second support structure 32 by a drive unit bracket 58. In the shown example, the drive unit bracket 58 can be formed from two projections that project from the second support structure 32. The projections can define a gap extending therebetween, such that a connecting portion 59 of the first drive unit 36 can be positioned between the projections. The drive unit bracket 58 and connecting portion 59 can each have a hole extending therethrough, such that a screw, bolt, or the like can extend through the hole and attach the connecting portion 59 to the drive unit bracket 58. Accordingly, with the screw in place, the first drive unit 36 is attached to the second support structure 32. The attachment of the first drive unit 36 to the second support structure 32 is not limited to the shown example, however. In other examples, the first drive unit 36 could be attached by a snap fit attachment, or by being screwed directly to a portion of the second support structure 32. Similarly, the first drive unit 36 could include two projections to surround a connecting portion extending from the second support structure 32. Moreover, the projections and/or the connecting portion can each be formed integrally with their respective structure, or could be a separate structure that is attached.

The first drive unit 36 can include a motor 37 that is operatively connected to the second end of the second arm 40. The motor 37 can include a variety of motors, including servomotors, electric motors, electrostatic motors, etc. Similarly, the motor 37 can be powered by AC or DC with wires (not shown) connecting the motor 37 to a power source. The motor 37 can be connected to an output shaft, such as a threaded shaft 54. The motor 37 can be configured to rotate the threaded shaft 54. The threaded shaft 54 can be oriented along a substantially horizontal plane. The threaded shaft 54 can be rotatably attached to the carriage 52 such that the threaded shaft 54 and first drive unit 36 are in operative association with the scissor support assembly 34. In the shown example, the threaded shaft 54 can be rotatably inserted into a threaded aperture in the carriage 52. Rotation of the threaded shaft 54 can cause the carriage 52 to move with respect to the threaded shaft 54. Accordingly, by rotating the threaded shaft 54 in a first direction, the carriage 52 can move along the threaded shaft 54 in a direction towards the first drive unit 36. Conversely, by rotating the threaded shaft 54 in a second direction opposite to the first direction, the carriage 52 can move along the threaded shaft 54 in a direction away from the first drive unit 36. In further examples, the threaded shaft 54 can include a drive block 56. The drive block 56 can be rotatably attached to the threaded shaft 54 and can apply force to the carriage 52. It is to be understood that a variety of structures and methods can be used for movably attaching the motor 37 to the carriage 52. For instance, the threaded shaft 54 could be secured to the carriage 52, such that the threaded shaft 54 and carriage 52 move together as one piece. Accordingly, the threaded shaft 54 could translate in two directions: (1) toward the motor 37 and away from the scissor support assembly 34, and (2) away from the motor 37 and toward the scissor support assembly 34. As such, translation of the threaded shaft 54 in the first direction (toward the motor 37) can cause the carriage 52 to move in a direction towards the first drive unit 36 while translation of the threaded shaft 54 in the second direction (away from the motor) can cause the carriage 52 to move in a direction away from the first drive unit 36.

Referring to FIGS. 4 and 5, the lifting and lowering motion of the first support structure 30 and storage bin 18 with respect to the second support structure 32 can now be described. First, the lowering of the storage bin 18 on the first support structure 30 from the raised position will be described. When the drive block 56 rotates to draw the carriage 52 towards the first drive unit 36 (i.e., to the left in FIG. 4), the lower ends of the second arm 40 will slide toward the first drive unit 36. The lower ends of the first arm 38 and the upper ends of the second arm 40 will pivot with respect to the second support structure 32 and first support structure 30, respectively. Due to the pivotal connection between the first arm 38 and second arm 40 at arm pivot 42, the upper ends of the first arm 38 can slide toward the first drive unit 36 (i.e., to the left in FIG. 2). Accordingly, with the first arm 38 and second arm 40 sliding towards the first drive unit 36, the first support structure 30 can move in a downward direction towards the second support structure 32. Consequently, the downward motion of the first support structure will cause the storage bin 18 to move downward as well. The motor 37 can stop at any point to stop the rotation of the drive block 56. When the rotation stops, the first support structure 30 can remain in an intermediate position until the rotation of the drive block 56 re-commences. Upon re-commencing the rotation of the drive block 56, the storage bin 18 and first support structure 30 can continue to lower until engaging with the second support structure 32 at its lowest point.

Next, the storage bin 18 and first support structure 30 can be raised from the lowered position to the raised position. To accomplish this, the motor 37 can rotate the drive block 56 in an opposite direction, causing the carriage 52 to move away from the first drive unit 36 (i.e., to the right in FIG. 4). The lower ends of the second arm 40 will correspondingly slide away from the first drive unit 36. The lower ends of the first arm 38 and the upper ends of the second arm 40 will pivot with respect to the second support structure 32 and first support structure 30, respectively. Again, due to the pivotal connection between the first arm 38 and second arm 40 at arm pivot 42, the upper ends of the first arm 38 can slide away from the first drive unit 36 (i.e., to the right in FIG. 2). Accordingly, with the first arm 38 and second arm 40 sliding away from the first drive unit 36, the storage bin 18 and first support structure 30 can move in an upward direction away from the second support structure 32. The motor 37 can stop after a predetermined time, such that the first support structure 30 stops at a desired raised position. Accordingly, horizontal movement of the threaded shaft 54 can raise and lower the first support structure 30 and storage bin 18 with respect to the second support structure 32.

Figure 6:
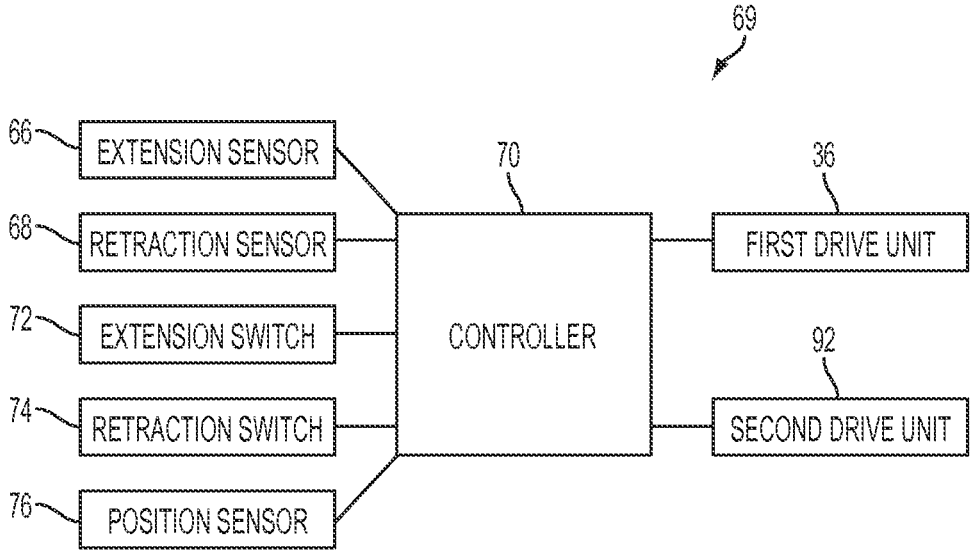
FIG. 6 is a block diagram showing the storage bin movement control system.

Referring now to FIG. 6, the control of the movement of the storage bin 18 can be governed using a storage bin movement control system 69. A block diagram is shown of a storage bin movement control system 69. As shown, one example of the storage bin movement control system 69 includes an extension sensor 66 and a retraction sensor 68 that are configured to sense when the storage bin 18 has been extended or retracted by the lift mechanism, respectively. In the shown example, the extended position corresponds to the upper or raised position and the retracted position corresponds to the lower or retracted position.

The storage bin movement control system 69 can further include a controller 70 that is operatively connected to the first drive unit 36. When activated, either the extension sensor 66 or retraction sensor 68 can send a signal to the controller 70 to deactivate the first drive unit 36, thereby stopping the motion of the storage bin 18. More specifically, the extension sensor 66 is configured to send a signal to the controller 70 to deactivate the first drive unit 36 when the storage bin is in a fully extended and raised position. Likewise, the retraction sensor 68 is configured to send a signal to the controller 70 to deactivate the first drive unit 36 when the storage bin 18 is in a fully retracted and lowered position. The extension sensor 66 and the retraction sensor 68 may be limit switches that send a signal to the controller 70 upon contact with the storage bin 18 or the lift mechanism 28. Alternately, the sensors may be other types of sensors, such as optical sensors.

The user may activate the movement of storage bin 18 and the lift mechanism 28 in various different ways. For example, the movement of the storage bin 18 may be directly controlled by the user using switches. In the shown example, the storage bin movement control system 69 may include an extension switch 72 and a retraction switch 74. These switches may be positioned anywhere on the refrigerator 10. For example, as shown in FIG. 1, they may be positioned on the bin door 20. When the extension switch 72 is activated by the user, the controller 70 can send a signal to the first drive unit 36 to extend the lift mechanism 28 (e.g., move it upwards). Movement will then cease when the extension sensor 66 is activated. Likewise, when the retraction switch 74 is activated by the user, the controller 70 sends a signal to the first drive unit 36 to retract the lift mechanism 28 (e.g., move it downwards). In this case, movement will cease when the retraction sensor 68 is activated. Alternately, the extension switch 72 and retraction switch 74 can enable movement only when held down by the user. While the term "switch" has been used to describe the input device, it should be understood that the term, as used herein, encompasses a wide variety of other input devices, such as pushbuttons, levers, or the like.

As described above, the extension switch 72 and retraction switch 74 can be used to extend or retract the storage bin 18 in response to user input after the storage bin 18 has been manually withdrawn from the refrigerator compartment. To prevent operation of the lift mechanism 28 before the storage bin has cleared the refrigerator compartment, a position sensor 76 can be included. The position sensor 76 can be configured to detect when the storage bin 18 has been sufficiently withdrawn from the refrigerator compartment so that it can be raised without being blocked. For instance, the bin door 20 can be pulled out from the lower compartment 12. The bin door 20 can be either fully pulled out or near fully pulled out such that the storage bin 18 can freely be raised without striking the upper wall of the lower compartment 12. Accordingly, the position sensor 76 can be configured to signal to the controller 70 when the storage bin 18 is clear of obstructions and clear of the lower compartment 12, thereby enabling movement by the first drive unit 36. In further examples, the position sensor 76 may also be used to signal the first drive unit 36 to raise the storage bin 18 by extending the lift mechanism 28 automatically upon manual withdrawal of the storage bin 18. The position sensor 76 may also be configured to detect an attempt to close the bin door 20 and push the storage bin 18 back into the lower compartment 12 while the storage bin 18 is still in a raised position. In that example, the position sensor 76 can trigger the lowering of the storage bin 18 or provide a signal to the user that the storage bin 18 has not been lowered.

In further examples, the refrigerator 10 may also include a second drive unit 92 configured to move the slides 22 and the associated storage bin. For example, the second drive unit 92 can automatically retract the bin door 20 from the lower compartment 12, thereby exposing the storage bin 18. In such an example, the movement of the storage bin 18 along the slides 22 can be power-driven. For example, the second drive unit 92 may be included together with a second drive mechanism (not shown) that provides force to move the storage bin 18 out of (i.e., opening) and/or into (i.e., closing) the lower compartment 12. This may be done by applying force to the inner rail 24 in the slides 22. The second drive unit 92 can provide for opening and then raising the storage bin 18, or lowering and then closing the storage bin 18 through the coordinated action of the first drive unit 36 and the second drive unit 92. The coordinated opening and lifting and/or closing and lowering movements can be initiated in a variety of ways. For example, it may be initiated using the extension switch 72 and retraction switch 74, or it may be triggered by a slight push by the user on the bin door 20, which will either lower and close the storage bin 18 or open and raise the storage bin 18, depending on the current position of the storage bin 18. Further, the second drive unit 92 can be activated by a button, lever, switch, or the like. The controller 70 can provide an output that governs the activation of the second drive unit 92.

Figure 7:
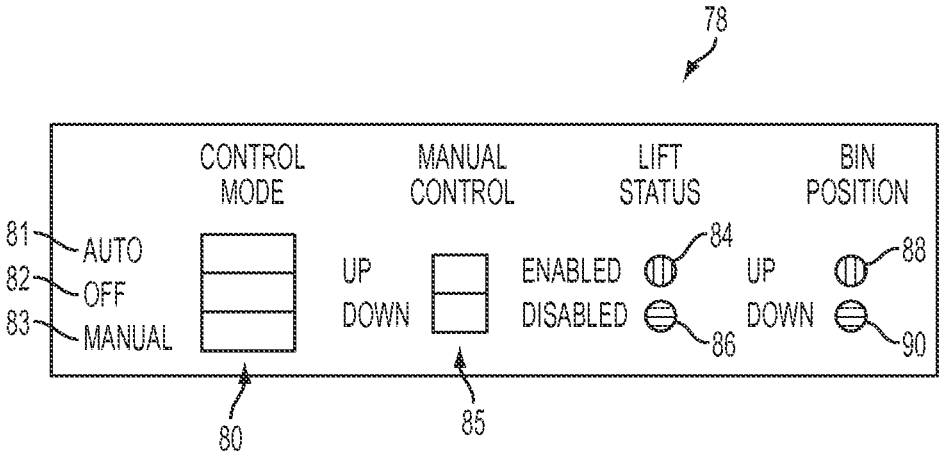
FIG. 7 is a front view of a user interface for the storage bin movement control system.

Referring now to FIG. 7, a control interface 78 is shown that can be used with the storage bin movement control system 69. The storage bin 18 can be used in place of the extension switch 72 and retraction switch 74. In this example, the user can switch between an automatic mode, a manual mode, and an off mode, to enable either automatic or manual control of the lift mechanism 28. To switch between automatic control, manual control, and off mode, a three position control mode switch 80 may be provided that includes an off position 82, an automatic position 81, and a manual position 83. In the off position 82, the lift mechanism 28 will not be signaled to move the storage bin 18. In the manual position 83, the lift mechanism 28 can move the storage bin 18 up or down in response to the position of a two position manual control switch 85, which has an up position and a down position, and operates in the two different modes described for the extension switch 72 and retraction switch 74. In the automatic position, the lift mechanism 28 will move away from whichever position it currently occupies (i.e., up or down) until it has either extended (e.g., raised) or lowered (e.g., retracted) completely, as registered by the extension sensor 66 and retraction sensor 68.

As described above, the lift mechanism 28 can operate if enabled by the position sensor 76. The position sensor 76 can indicate whether the storage bin 18 can be raised without striking an upper wall of the lower compartment 12. The control interface 78 may also provide information regarding whether the lift mechanism 28 is enabled, and/or what the current position of the storage bin 18 is. For example, the control interface 78 may include indicators such as indicator lights. In the example shown in FIG. 8, the control interface 78 includes four indicator lights, which illuminate to indicate present status of the lift mechanism and its control system. The indicator lights include a lift enabled indicator 84, and lift disabled indicator 86, a lift extended indicator 88, and a lift retracted indicator 90. The lift enabled indicator 84 can indicate whether the bin door 20 is completely or near completely withdrawn from the lower compartment 12, such that the storage bin 18 can safely be raised without striking the upper wall of the lower compartment 12. The lift disabled indicator 86 can indicate that the bin door 20 needs to be withdrawn further from the lower compartment 12, such that the storage bin 18 can be safely raised. The lift extended indicator 88 can indicate that the storage bin 18 has reached a fully raised or "UP" position. The lift retracted indicator 90 can indicate that the storage bin 18 has reached a fully lowered or "DOWN" position. It is to be understood that other methods and structures of indicating the present status of the lift mechanism are also contemplated, such as audible beeps, audible warning signals, or the like.

It is to be understood that the storage bin movement control system 69 and the control interface 78 could be positioned nearly anywhere on the refrigerator 10. For instance, in the shown example of FIG. 1, the storage bin movement control system 69 and the control interface 78 are shown to be positioned on an upper portion of the bin door 20. However, it is to be understood that the storage bin movement control system 69 and the control interface 78 could be positioned on the doors 16, on the front face of the bin door 20, etc.

Example embodiments have been described with reference to the examples described above. Modifications and alterations will occur to others upon a reading and understanding of this specification. Example embodiments incorporating one or more aspects are intended to include all such modifications and alterations insofar as they come within the scope of the appended claims.

What is claimed is:

1. A refrigerator including:
- a refrigerator compartment;
- a storage bin positioned within the refrigerator compartment; and
- a lift mechanism including:
  - a first support structure configured to support the storage bin;
  - a second support structure configured to support the first support structure;
  - a door attached to the second support structure to close the storage bin in the refrigerator compartment;
  - at least one scissor support assembly coupled between the first support structure and the second support structure; wherein the first support structure is configured to selectively raise and lower with respect to the second support structure; and
  - a first drive unit operatively connected to move the at least one scissor support assembly, the first drive unit being positioned within the second support structure and on an opposite side of the first support structure with respect to the door when the first support structure is in a lowered position.

2. The refrigerator of claim 1, further including a sliding mechanism configured to slidably attach the door to the refrigerator compartment.

3. The refrigerator of claim 2, wherein the sliding mechanism includes a first slide and a second slide.

4. The refrigerator of claim 1, wherein the at least one scissor support assembly includes a first scissor support assembly and a second scissor support assembly.

5. The refrigerator of claim 4, wherein each of the first scissor support assembly and the second scissor support assembly includes a first arm and a second arm, wherein each of the first arm and the second arm includes a first end, a second end and an intermediate portion, and the intermediate portion of the first arm is pivotally attached to the intermediate portion of the second arm.

6. The refrigerator of claim 5, wherein the second end of the first arm is pivotally attached to the second support structure.

7. The refrigerator of claim 6, wherein the second end of the second arm is configured to slidingly translate with respect to the second support structure.

8. The refrigerator of claim 7, wherein the second end of the second arm includes a roller configured to engage a path defined by the second support structure.

9. The refrigerator of claim 1, wherein the first drive unit is configured to selectively raise and lower the first support structure with respect to the second support structure.

10. The refrigerator of claim 1, further including a control system including a controller operatively connected to the first drive unit.

11. The refrigerator of claim 10, wherein the control system includes an extension sensor configured to send a signal to the controller to deactivate the first drive unit when the storage bin is in an extended position.

12. The refrigerator of claim 10, wherein the control system includes a retraction sensor configured to send a signal to the controller to deactivate the first drive unit when the storage bin is in a retracted position.

13. The refrigerator of claim 10, wherein the control system includes a user interface with an extension switch and a retraction switch.

14. The refrigerator of claim 1, wherein the storage bin includes a recessed portion configured to mate with the first support structure.

15. A refrigerator including:

a refrigerator compartment;

a storage bin positioned within the refrigerator compartment; and a lift mechanism including:

a first support structure configured to support the storage bin;

a second support structure configured to support the first support structure;

at least one scissor support assembly including a first arm and a second arm, wherein the first arm is configured to be pivotally attached to the second support structure and slidably attached to the first support structure, further wherein the second arm is configured to be slidably attached to the second support structure and pivotally attached to the first support structure; and a first drive unit positioned within the second support structure, the first drive unit operatively connected to the at least one scissor support assembly to selectively raise and lower the first support structure with respect to the second support structure, wherein the storage bin includes a recessed portion configured to mate with the first support structure.

16. The refrigerator of claim 15, further comprising at least one bracket arm configured to support the second support structure and attach the second support structure to the refrigerator compartment, wherein the first and second arms are positioned on a first side of the storage bin and the at least one bracket is positioned on a second side of the storage bin orthogonal to the first side.

17. The refrigerator of claim 15, further comprising at least one bracket arm and a sliding mechanism configured to slidably attach the storage bin to the refrigerator compartment, wherein an upper portion of the at least one bracket arm is attached to the sliding mechanism and a lower portion of the at least one bracket arm is attached to the second support structure such that the second support structure is arranged below the sliding mechanism.

18. A refrigerator including:

a refrigerator compartment;

a door configured to cover a front of the refrigerator compartment;

a sliding mechanism configured to removably attach the door to the refrigerator compartment;

a storage bin positioned within the refrigerator compartment; and a lift mechanism including:

a first support structure configured to support the storage bin;

a second support structure;

at least one scissor support assembly configured to movably attach the first support structure to the second support structure, wherein the at least one scissor support assembly is configured to be slidably and pivotally attached to each of the first support structure and the second support structure;

a first drive unit configured to raise and lower the first support structure with respect to the second support structure; and a position sensor configured to detect when the first support structure can be raised with the storage bin supported thereon clear of the refrigerator compartment.

19. The refrigerator of claim 18, wherein the first drive unit is configured to slide the at least one scissor support assembly with respect to the first support structure and the second support structure.

20. The refrigerator of claim 18, wherein the position sensor is configured to enable operation of the first drive unit when the position sensor detects that the first support structure can be raised with the storage bin supported thereon clear of the refrigerator compartment.

21. The refrigerator of claim 18, wherein the position sensor is configured to detect closing of the door while the storage bin is in a raised position.

22. The refrigerator of claim 21, wherein upon detecting closing of the door while the storage bin is in the raised position, the position sensor is configured to trigger lowering of the storage bin.

23. The refrigerator of claim 18, further comprising a lift disabled indicator configured to indicate whether the bin door needs to be withdrawn further from the lower compartment such that the storage bin can be raised clear of the refrigerator compartment.

* * * * *